United States Patent [19]

Hays

[11] Patent Number: 4,592,515

[45] Date of Patent: Jun. 3, 1986

[54] SOIL PULVERIZING MILL

[75] Inventor: Robert C. Hays, Fresno, Calif.

[73] Assignee: The United States of American as represented by the Secretary of the Interior, Washington, D.C.

[21] Appl. No.: 669,151

[22] Filed: Nov. 7, 1984

[51] Int. Cl.[4] ..... B02C 13/282

[52] U.S. Cl. ..... 241/69; 241/189 R

[58] Field of Search ..... 241/79, 100, 69, 168, 241/169.1, 169.2, 189 R, 191, 193, 194, 195, 101.7, 196, 285 R, 188 R, 101.1

[56] References Cited

U.S. PATENT DOCUMENTS

| | | | |
|---|---|---|---|
| 1,460,747 | 7/1923 | Crowell | 241/193 |
| 3,752,410 | 8/1973 | Dienst et al. | 241/69 |
| 3,806,047 | 4/1974 | Ober | 241/188 R |
| 3,905,181 | 9/1975 | Messner | 241/101.1 X |
| 4,325,516 | 4/1982 | Ismar | 241/188 R X |

FOREIGN PATENT DOCUMENTS

| | | | |
|---|---|---|---|
| 1026932 | 3/1958 | Fed. Rep. of Germany | 241/100 |

*Primary Examiner*—Mark Rosenbaum
*Attorney, Agent, or Firm*—Thomas Zack

[57] ABSTRACT

A compact, portable pulverizing apparatus having a plurality of beater-bars (14) rotatably mounted to a plurality of support rods (16). The support rods (16) are eccentrically disposed about the periphery of two support disks (17). The support disks (17) are driven by a drive shaft (19) that connects to a power unit (13). The beater-bars (14) are supported about a sole plate (22) having an opening (23) disposed therethrough to allow the beater-bars (14) to contact the material to be pulverized. Handles (24) are connected to the sole plate (22) to allow it to be moved about as desired.

6 Claims, 5 Drawing Figures

FIG. 1.
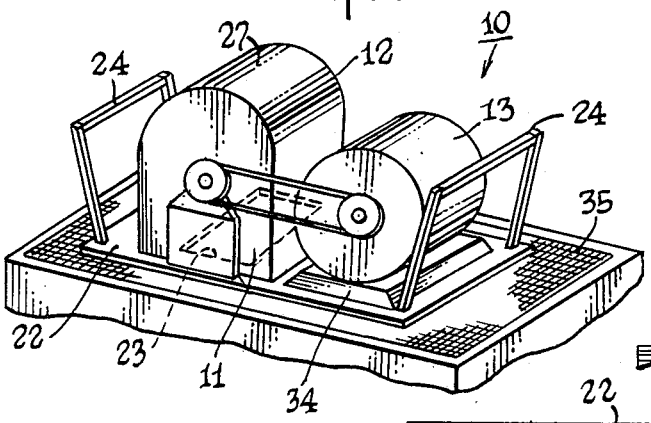
FIG. 2.
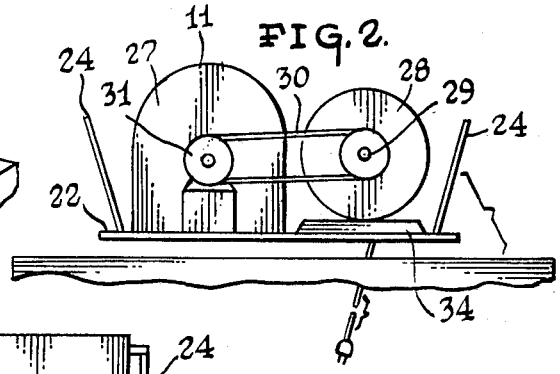
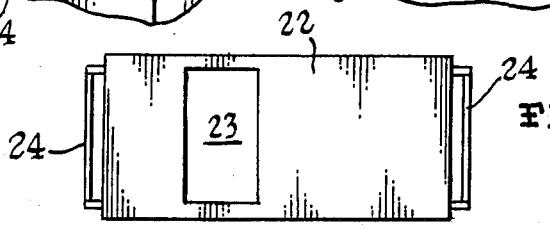
FIG. 5.
FIG. 3.
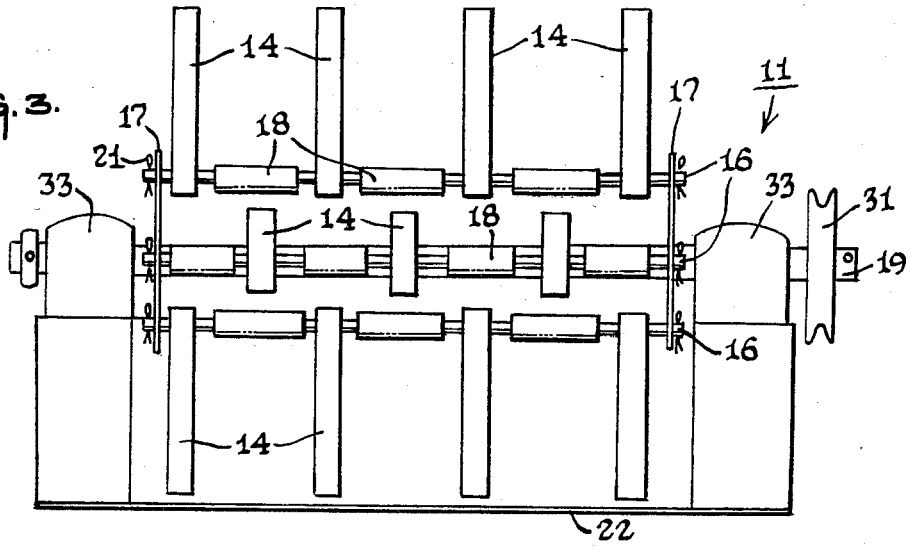
FIG. 4.
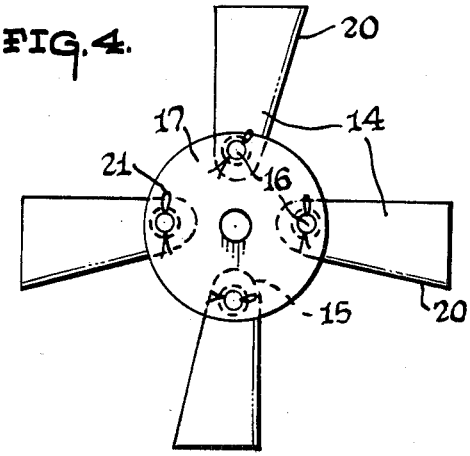

SOIL PULVERIZING MILL

TECHNICAL FIELD

This invention relates generally to a compact, portable, power-driven pulverizer for conjunctive use with a soil screen, wherein said pulverizer aids in breaking up a composition of matter such that a desired size of matter will pass through the screen.

BACKGROUND ART

In many industries, it is necessary to conduct analytical tests on various compositions of matter, such as soil samples. To conduct an accurate test, the soil must be free of foreign matter. To obtain such a pure soil sample, the soil must be separated from any unwanted matter.

To accomplish this, the prior art teaches the use of separating devices having a screen. Small soil samples are able to pass through the screen while the larger unwanted materials, such as rocks, are unable to pass through the screen. Often, soil will pass through the screen by simple gravitational pull. In many situations the process can be aided by use of a power source to oscillate the screen. In some instances, however, the soil sample will remain in chucks that are too large to pass through the screen, even when oscillating the screen.

To resolve this problem, some separating devices include a pulverizing unit that break up the large soil units into smaller ones, that can pass through the screen. Such separating devices are non-moveable with respect to the screen and the matter to be pulverized. In use, the matter must be somehow introduced into the area where the stationary pulverizing unit will act upon it. In use, large soil units may avoid the pulverizing area and defect the purpose of the apparatus.

Further, even within the pulverizing area, the soil units may avoid being broken up by accumulating in an area between the beaters. To resolve this problem, the device must be shut off and an operator must manually redistribute the soil to enable the stationary pulverizing unit to break up the soil.

Preferably, such an apparatus should be capable of engaging the matter to be pulverized substantially over the entire soil screen. If the matter tends to accumulate in a particular area, the pulverizing unit should be capable of being easily moved to that area without being shut off. Further, such an apparatus should not allow matter to accumulate between beaters. Such an apparatus should also be lightweight and portable to minimize effort on the part of the operator.

DISCLOSURE OF THE INVENTION

These and other needs are substantially met through provision of the pulverizing apparatus disclosed in this specification. This apparatus includes generally a pulverizing unit, a housing unit, and a power unit.

The pulverizing unit includes a plurality of beater-bars and a plurality of support rods such that each support rod has at least one beater-bar attached thereto. The support rods include a plurality of conduit spacers for disposition between the beater-bars. The plurality of support rods are eccentrically affixed to first and second support disks. A drive shaft affixes to the power unit and to the support disks. When the power unit operates, the drive shaft will rotate the support disks, which in turn will rotate the beater-bars eccentrically about the drive shaft. During non-use, the beater-bars repose downwardly with respect to the support rods. During use, the beater-bars extend outwardly due to centrifugal force. Movement of the beater-bars creates a sufficient force to crush the soil matter. Since the beater-bars can rotate with respect to the support rods, the beater-bars will give way when encountering hard objects such as rocks and pass over them without causing excessive wear on the beater-bars.

The beater-bars and conduit spacers are alternately spaced on each support rod. The beater-bars of one support rod will be aligned with the conduit spacers on the next adjacent support bar. This configuration minimizes the gap space between beater-bars as they rotate. In effect, the rotating beater-bars are substantially disposed along the entire cross sectional operating area of the pulverizing unit. This greatly minimizes any gaps between beater-bars where matter may accumulate. Further, any matter that may accumulate between beater-bars can be easily pulverized by simply moving the apparatus.

The housing unit generally includes a removable shield that encloses the pulverizing unit. The removable shield protects the device and prevents scattering of soil. A sole plate member attaches to the bottom surface of the housing unit to provide a surface for mounting the power unit and pulverizing unit. The sole plate member further facilitates movability of the apparatus along a soil screen. The sole plate has a sole plate opening disposed therethrough to allow an interface between the beater-bars and the soil matter to be pulverized. The housing unit further includes a handle for allowing an operator to selectively maneuver the apparatus about the screen.

The power unit generally includes an electric motor having a pulley attached thereto. A belt engages the pulley and extends to a pulley connected to the drive shaft of the pulverizing unit. This connects the power unit to the pulverizing unit. The power unit attaches to the housing unit by a motor mount unit.

BRIEF DESCRIPTION OF THE DRAWINGS

FIG. 1 comprises a perspective view of the pulverizer in conjunctive use with a screen;

FIG. 2 comprises a side elevational view of the pulverizer;

FIG. 3 comprises an enlarged front elevational view of the pulverizing unit;

FIG. 4 comprises an enlarged side elevational view of a support disk having a plurality of beater-bars eccentrically affixed thereto; and FIG. 5 comprises an enlarged bottom elevational view of the pulverizing apparatus including the handle means and housing unit.

BEST MODE FOR CARRYING OUT THE INVENTION

Referring now to the drawings, and in particular to FIG. 1, the apparatus can be seen as generally depicted by the numeral 10. The apparatus (10) generally includes a pulverizing unit (11), a housing unit (12), and a power unit (13). These generally described components will now be described in more detail in seriatim fashion.

As seen in FIGS. 3 and 4, the pulverizing unit (11) comprises a plurality of beater-bars (14) that are rotatably attached to a plurality of support rods (16). This particular embodiment has four support rods (16) that attach at their ends to first and second support disks (17). As seen in FIG. 4, the support rods (16) are attached eccentrically about the support disks (17).

A plurality of conduit spacers (18) are disposed on the support rods (16) and positioned between the beater-bars (14) and the support disks (17) to keep the beater-bars (14) at a desired distance from one another. The beater-bars (14) of a particular support rod (16) are spaced so that they are aligned with the conduit spacers (18) of the next adjacent support rod (16). This alignment maximizes interaction between the matter to be pulverized and the beater-bars (14).

A drive shaft (19) may be connected to both support disks (17) through holes provided therefor. As the drive shaft (19) rotates, so rotates the support disks (17).

As seen in FIG. 4, the beater-bars (14) each comprise a substantially rectangular member having a rounded end (15) for attachment to the support rod (16). The support rods (16) attach to the support disks (17) through holes disposed through the support disks and are secured by a pin (21). The beater-bars (14) further include an angled front side (20) to enhance pulverizing capability. The beater-bars (14) may be made of rubber or metal, or any other desirable material.

As seen in FIGS. 1, 2 and 5, the housing unit (12) includes a substantially planar sole plate (22) having the power unit (13) and the pulverizing unit (11) attached thereto. The sole plate (22) includes an opening (23) disposed therein. The opening (23) provides for an area where the beater-bars (14) may interact with the soil on the screen (35). The housing unit (12) further includes handles (24) that may be grasped to allowing selective movement of the apparatus (10) about the screen (35). Finally, the housing unit (12) includes a removable shield (27) disposed about the pulverizing unit (11) to provide a safety shield and also to aid in preventing the scattering of soil.

Referring now to FIG. 2, the power unit (13) includes an electric motor (28) that connects to the sole plate (22) of the housing unit (12) through use of a motor mount unit (34) having a first pulley (29) attached thereto. A drive belt (30) attaches to the first pulley (29) and extends to a second pulley (31) that attaches to the drive shaft (19) of the pulverizing unit (11).

With reference to FIG. 3, the drive shaft (19) is supported by two bearing units (33) that are attached to the sole plate (22) of the housing unit (12). The electric motor (28) supplies rotational movement to the first pulley (29) to thereby cause the second pulley (31) to rotate and power the drive shaft (19) of the pulverizing unit (11).

The apparatus (10) is generally used to pulverize large segments of matter into smaller segments. The composition of matter may be placed on the screen (35) and the apparatus (10) will pulverize the large segments into smaller segments that may pass through the screen (35).

The beater-bars (14) rotate eccentrically about the drive shaft with sufficient force to break up clumps of soil that they contact. Though the beater-bars (14) are rotatably affixed to the support rods (16), they exert a sufficient centrifugal force to accomplish this task. Because the beater-bars (14) are rotatably affixed to the support rods (16), they are capable of retraction. To this end, should they engage a foreign object too hard to break up, the beater-bars (14) will simply give way and pass over it. This aids in maintaining a longer useful life for the beater-bars (14).

Since the operator of the pulverizing apparatus (10) can selectively move the apparatus (10) about the soil screen (35), the beater-bars (14) can operate over substantially the entire area of the soil screen (35). Therefore, the operator can move the apparatus (10) to an area where the apparatus is most needed, such as an area where there is a large accumulation of soil.

Obviously, many changes can be made with respect to the above described invention without expanding upon the basic inventive concepts set forth. Such modifications are not to be considered as outside the scope of the claims except as may be expressly provided therein.

I claim:

1. A compact, portable, power driven pulverizing apparatus in combination with a screen and a composition of matter interposed between the pulverizing apparatus and the screen, wherein the pulverizing apparatus comprises:

(a) pulverizing means including a plurality of beater-bars for breaking up said composition of matter;

(b) a power unit operably attached to said pulverizing means; and, (c) a housing unit including a support member for attaching to said pulverizing means and said power unit, said support member comprising a substantially planar sole plate member having an opening formed therein, wherein the housing unit further includes handle means for allowing selective movement of said pulverizing means with respect to said composition of matter and said screen such that said beater-bars can selectively engage said composition of matter through said sole plate opening to break up a desired area of said composition of matter whereby the smaller segments of said composition of matter will pass through said screen.

2. The pulverizing apparatus of claim 1 including a plurality of support rods wherein each said support rod has at least one beater-bar attached thereto, said support rod being eccentrically affixed between a first and second support disk.

3. The pulverizing apparatus of claim 2 wherein said first and second support disks are affixed to a drive shaft, such that when said drive shaft rotates, said support disks correspondingly rotate and cause said beater-bars to rotate eccentrically about said drive shaft.

4. The pulverizing apparatus of claim 3 and further including a plurality of conduit spacers disposed on said support rods such that said conduit spacers separate said beater-bars from one another to a desired distance.

5. The pulverizing apparatus of claim 4 wherein the beater-bars of one support rod are aligned substantially planar with said conduit spacers of a next adjacent support rod.

6. The pulverizing apparatus of claim 1 wherein said power unit includes an electric motor having a pulley affixed thereto.

* * * * *